US005275279A

United States Patent [19]

Grigsby

[11] Patent Number: 5,275,279

[45] Date of Patent: Jan. 4, 1994

[54] SHIPPING CONTAINER FOR AN OUTBOARD MOTOR

[75] Inventor: Charles F. Grigsby, Marietta, Ga.

[73] Assignee: North American Container Corporation, Mableton, Ga.

[21] Appl. No.: 19,465

[22] Filed: Feb. 18, 1993

[51] Int. Cl.[5] ..... B65D 85/68

[52] U.S. Cl. ..... 206/319; 206/586; 229/23 C

[58] Field of Search ..... 206/319, 320, 335, 386, 206/586, 600; 229/DIG.

[56] References Cited

U.S. PATENT DOCUMENTS

| | | | |
|---|---|---|---|
| 2,515,428 | 7/1950 | Scott et al. . | |
| 2,686,028 | 8/1954 | Johnson . | |
| 2,791,322 | 5/1957 | Boeye . | |
| 3,006,462 | 10/1961 | Boeye et al. . | |
| 3,317,034 | 5/1967 | Bowles et al. . | |
| 3,601,251 | 8/1971 | Schwaner . | |
| 4,706,809 | 11/1987 | Halsell | 206/319 |
| 4,792,041 | 12/1988 | Grigsby . | |
| 4,832,256 | 5/1989 | Grigsby . | |
| 4,938,350 | 7/1990 | Grigsby | 206/319 |
| 5,069,338 | 12/1991 | Grigsby | 206/319 |
| 5,096,112 | 3/1992 | Grigsby | 229/23 C |

*Primary Examiner*—Steven N. Meyers
*Assistant Examiner*—Jacob K. Ackun, Jr.
*Attorney, Agent, or Firm*—Kennedy & Kennedy

[57] ABSTRACT

A container for storing and shipping outboard motors horizontally. The motor attaches to an H-frame by screwing the bolts on the stern bracket to a cross bar. Vertical cleats attach to the sides of a corrugated paperboard carton, and the cleats guide the H-frame into the carton. A hold-down pad formed by folding a blank of corrugated paperboard having scores defining a plurality of panels attaches to an end wall and engages the skeg of the motor to restrict pivotable movement of the motor during shipping and handling.

3 Claims, 2 Drawing Sheets

SHIPPING CONTAINER FOR AN OUTBOARD MOTOR

TECHNICAL FIELD

The present invention relates to reinforced corrugated paperboard shipping containers for outboard motors. More particularly, the present invention relates to a reinforced corrugated paperboard shipping container that holds an outboard motor horizontally.

BACKGROUND OF THE PRESENT INVENTION

Heavy products such as outboard boat motors are generally packaged in a container for handling and shipping purposes. Often these motors weigh several hundred pounds. The containers for such heavy products must include adequate strength to permit handling of the packaged motors with fork lift trucks or clamp trucks. Manufacturers produce large quantities in assembly line manner and must be able to stack the packaged motors up to eight or more units high in their warehouse. The cost of warehousing is expensive and normally such warehouses are built with very high ceiling heights to increase the product storage per cubic foot of space. Therefore, such containers must be adequate in compression or stacking strength to safely allow the maximum number of units in a stack.

Another substantial cost incurred by manufacturers of outboard boat motors is the freight cost associated with shipping the motors from the manufacturer's plant to the distributor or dealer. Due to the size and shape of the motors, it is necessary that as many packaged motors as possible be loaded into a van or trailer to minimize the freight cost per unit. This requires that the container be of minimal external dimensions given the physical dimensions of the particular motor and the required internal container dimensions to accommodate some movement of the motor in the container. The container must have sufficient vertical and horizontal stacking strength. Vertical strength allows the packaged motors to be stacked to the maximum height available in the shipping trailer. Adequate lateral strength enables the container to resist sideways collapse during stacked shipment. The uppermost units in a stack exert lateral stresses on the lower containers due to the stopping and starting horizontal forces incurred during transit.

An outboard motor presents a very difficult packaging problem for several reasons. Such motors are of non-symmetrical construction in both longitudinal and traverse dimensions and in weight distribution. The engine, or powerhead, is the largest and heaviest component of the motor and is located at an upper end of the motor. The powerhead is connected through an adaptor casting to the gearcase which is a relatively long and lightweight semi-rectangular section that houses the drive shaft and gearing. The propeller shaft connects to the end of the drive shaft through another gearing mechanism. A lower rudder-shaped extension called a skeg is attached at the lower end of the motor. A mounting bracket, or stern bracket, connects to the powerhead near the junction of the powerhead and the gearcase. The stern bracket mounts the outboard motor to the stern of a boat. The stern bracket incorporates a pivot mechanism which allows the motor to pivot in the horizontal plane for steering purposes. The stern bracket also incorporates a tilting mechanism which allows the motor to be tilted in the vertical plane to adjust for different weight loading distributions in the boat, speeds and planing factors.

Typically, the powerhead is enclosed by a fiberglass hood or cover. Very close tolerances exist between certain components of the powerhead and the motor cover. Such components in the powerhead often have relatively sharp and hard surfaces and can damage the fiberglass motor cover if the motor cover is forced into them by external shocks incurred during handling and transit. Also, the powerhead itself is normally mounted to the gearcase section through the adaptor casting with rubber shock absorbing motor mounts. These mounts prevent excess vibration when the motor is in operation, but they allow some internal movement of the motor inside the motor cover. This internal movement can crack the motor cover in cases of rough handling or mishandling during transit.

For the several reasons outlined above, it is advantageous to support the motor by its stern bracket in a shipping container and not by the external surfaces of the motor cover. The motor cover and powerhead must be allowed to move in unison when subjected to external handling and shipping shock forces. This movement reduces the possibility of the engine components damaging the motor cover are reduced. For example, motor covers are expensive, typically costing several hundred dollars, and damage to them in handling and shipment are of major concern to the outboard motor manufacturer.

Most outboard motor manufacturers have rigid testing requirements for their shipping containers. These manufacturers have found through actual shipping experience that often the motors are mishandled in warehousing and transit. Motors are occasionally dropped by fork or clamp truck operators in handling and stacking. Also, if proper loading is not accomplished in truck or rail car shipment, the stacked containers can shift and fall. Many boat dealers do not have adequate loading docks or material handling equipment to properly unload their motors from the freight hauler's trailer. In these cases, the packaged motors are manually "walked" or pushed to the back of the trailer and lowered down to ground level by hand. Dropping of the container can occur in these cases with resultant damage to the motors if the container is of insufficient strength.

Because such outboard motors may cost many thousands of dollars, the protection of motors during handling, warehousing, and shipping is of primary importance to manufacturers. A container for shipping outboard boat motors must be externally strong and rigid enough to maximize warehouse space utilization through multiple stacking. The container must be strong enough to resist collapse during stacked shipment and to protect the motor in cases of mishandling, such as dropping from trailers during unloading. The container must be of minimal external dimensions to allow the greatest number of units to be loaded into a trailer for shipment. Yet the must have adequate internal shock absorption and clearance between the motor cover and other components and the container walls to prevent damage to the motor from external handling and shipping shock forces.

A further requirement of such outboard motor containers is that the container should facilitate easy and efficient packaging of the motor on the assembly lines. This mandates that the container be comprised of as few component parts as possible and that minimal labor is required to set up the package and insert the motor. Often the assembly lines run at high rates, up to 500 or more motors per day per line, and packaging simplicity is of major importance. Such containers must be designed to be shipped to the motor manufacturers from the container manufacturer in a collapsed or "knocked-down" state. This minimizes the freight costs associated with shipping the containers to the motor manufacturer. Also, and warehousing container space requirements and on-line container space requirements at the manufacturers will be minimized.

Outboard boat motors are shipped in either a vertical or horizontal orientation. In the vertical orientation, the outboard motor is normally loaded into the shipping container with the powerhead down so as to keep the center of gravity as low as possible in the container to resist tipping over during handling and shipment. In such a vertical pack, the motor is secured to a motor frame or crossbar by bolting through the stern bracket in a manner similar to attaching the motor to the stern of a boat. Typically such containers have vertical supports to provide stacking strength, as well as top and bottom frames to allow for forklift and clamp truck handling.

In the horizontal shipping orientation, the motor is placed horizontal, or nearly so, onto a base or skid assembly which allows fork lift entry for handling. Normally the motor is attached to a cross bar that simulates the stern of a boat and some means are used to secure the cross bar to the base. Care must be taken to prevent the motor from pivoting or turning about its swivel bracket which is the mechanism attached to the stern bracket that allows the motor to turn from side to side in steering the boat. If some method of restraining the motor is not provided for, it can swivel and contact the container walls during handling and shipment, possibly damaging the motor and container. In a mishandling situation such as a drop, the container itself must withstand the shock and prevent the motor from swiveling or torquing to the degree that it comes in contact with the container wall and the floor, fork lift mast, or other hard surfaces beyond the container walls.

In the horizontal container, a box surrounds the motor and attaches to the base. As discussed above, the box must be of sufficient strength to allow for warehouse stacking up to eight or more units high and for stacked truck or rail car shipment. In addition the box must have vertical strength through to the top surface so that misalignment in stacking will not result in the upper units falling through and crushing the lower units in a stack. As those of ordinary skill will understand, a box or container achieves most of its stacking strength at the corners where the right angles between the sides and end walls of the box join. If such a box is to be further reinforced by either internal or external vertical posts or columns, either mechanically attached to the walls of the box or simply designed to be placed or restrained next to the walls in some manner, said columns or posts are almost universally located at or as near as possible to the corners of the box. This is so that the right angles formed at the corners will provide the maximum vertical stabilization to the posts, which are the major load bearing members in warehouse or trailer stacking.

In freight shipments of less than full truckloads, freight carriers will often place other packages of various sizes and weights on one another to maximize revenue per loaded mile. The top of the box must therefore have sufficient bracing or strength to withstand small, heavy packages centerloaded onto it, away from the corners.

The base of such horizontal containers must be stiff and rigid enough to allow the packaged motors to be picked up by fork lift trucks while stacked several units high. This is necessary to facilitate and minimize truck loading time and handling time from the assembly lines to the warehouse. Many manufacturers use clamp, or squeeze trucks instead of fork lift trucks. Clamp trucks employ hydraulically operated platens that exert inward pressure onto the container walls, enabling the mast cylinder of the clamp truck to raise the package for loading or stacking. In such cases, the container must have adequate strength across its length and width to withstand the clamp pressure. A container that crushes in clamp handling can result in damage to the motor as well as becoming a safety hazard if the container slips from the platens during handling or stacking.

Containers known to be used in shipping outboard boat motors horizontally use wood bases with corrugated paperboard upper boxes. A plurality of corrugated paperboard or solid-fibre posts insert into the container to provide vertical and horizontal stacking and clamp strength. Such containers are cumbersome and slow to pack due to the many separate component parts. The corrugated upper box and posts may have adequate strength initially, but since corrugated paperboard is not resilient, crushing and loss of strength occur and increase with each handling step during the distribution cycle from manufacturers to distributors to dealer. Additionally, corrugated paperboard will lose up to 50% of its strength in conditions of high heat and humidity. Many shipments of outboard motors involve long periods of storage in closed vans or in warehouses where humidity levels can be 90% or higher. In such cases, previous containers grouped in stacks in warehouses have been known to fall with resultant damage costs and safety hazards. Also, due to the non-resilient nature of corrugated paperboard, the internal restraining posts and other inserted supports tend to weaken with the repetitive handling and shipping shocks. Handling and shipping applies forces to the posts and supports which loosen and allow the motor excessive movement within the container. Subsequent mishandling and drops can result in the momentum of the motor carrying it past the container wall into the floor, ground, lift truck mast or trailer wall, with damage occurring.

Some small outboard motors are known to have been shipped in styrofoam molded forms encased in a corrugated paperboard outer box. In these packs, the motor cover itself is the bearing surface. This is not a preferred method for the reasons mentioned above, and specifically because the powerhead can move on its rubber motor mounts during a drop or other mishandling and contact the rigidly restrained motor cover. Styrofoam also is becoming a disposal problem in many areas of the world, and the use of it is not desirable in such packaging for this reason as well. In addition, the foam packs do not have adequate rigidity in stacking or clamp handling.

Accordingly, there is a need in the art for an improved container for storing and shipping outboard motors.

SUMMARY OF THE INVENTION

The present invention solves the problems of the prior art by providing an improved container for storing and shipping outboard boat motors. Generally described, the present invention provides a reinforced corrugated paperboard container for packaging an outboard motor in a horizontal orientation for storing and shipping.

More particularly described, the present invention provides a container for holding an outboard motor in a horizontal orientation. The container includes a bottom and a top frame. Each comprises a pair of side members that are joined together by cross members at the respective ends and intermediate thereto. A regular slotted carton of corrugated paperboard receives the bottom and top frames. The carton includes two opposing side walls and two opposing end walls. A pair of first cleats attaches vertically to each of the end walls, and a second cleat attaches vertically to each side wall intermediate the end walls. The lower and upper ends of the first and the second cleats contact the respective side members of the frames.

An H-frame motor includes a pair of vertical side rails joined together by a cross bar. A stern bracket of an outboard motor bolts to the cross bar. The H-frame inserts into the container with the side rails contacting the second vertical cleats in the carton. A hold-down pad includes a channel along a transverse axis for receiving a skeg of the outboard motor. A transverse bar attaches to a side face of the hold-down pad. The transverse bar inserts and attaches between the cleats on one of the end walls for receiving the skeg in the channel. The hold-down pad restricts the motor from pivoting about the cross-bar during shipping and handling.

More particularly described, the hold-down pad comprises a plurality of sheets of corrugated paperboard adhered together with an adhesive. The channel tapers from a lower surface to the upper surface for matingly engaging the skeg.

More particularly described, the hold-down pad in an alternate embodiment comprises a blank of corrugated paperboard having a plurality of spaced-apart scores alternately in an upper and a lower surface of the blank. The blank is fan-folded on the scores to form the pad. A series of openings extends longitudinally from each score. The length of the openings progressively decreases to define the tapered channel in the folded hold-down pad for receiving the skeg.

More particularly described, the hold-down pad fan-folds from a blank of corrugated paperboard having a plurality of spaced-apart scores impressed alternately in an upper surface and a lower surface of the blank. The scores define a plurality of panels. A series of slots extends along the longitudinal axis of the blank towards the adjacent panel. In the pad, the slots form a channel that receives the skeg of the motor. The end panel does not include the slot. The end panel is preferably elongated to form a shelf that extends over the gearcase housing of the motor. A support member attaches to a rear face of the pad for securing the pad to a wall of the corrugated paperboard container.

Accordingly, it is an object of the present invention to improve containers for storing and shipping outboard motors.

It is another object of the present invention to reduce the number of parts necessary to package outboard motors for storing and shipping.

It is another object of the present invention to improve the pads for packing an outboard motor for storing and shipping.

It is another object of the present invention to reduce the time required to package an outboard motor on a assembly line.

These and other objects, advantages, and features of the present invention will become apparent from a reading of the following detailed description of the invention and claims in view of the appended drawings.

DETAILED DESCRIPTION OF THE PREFERRED EMBODIMENTS

Figure 1:
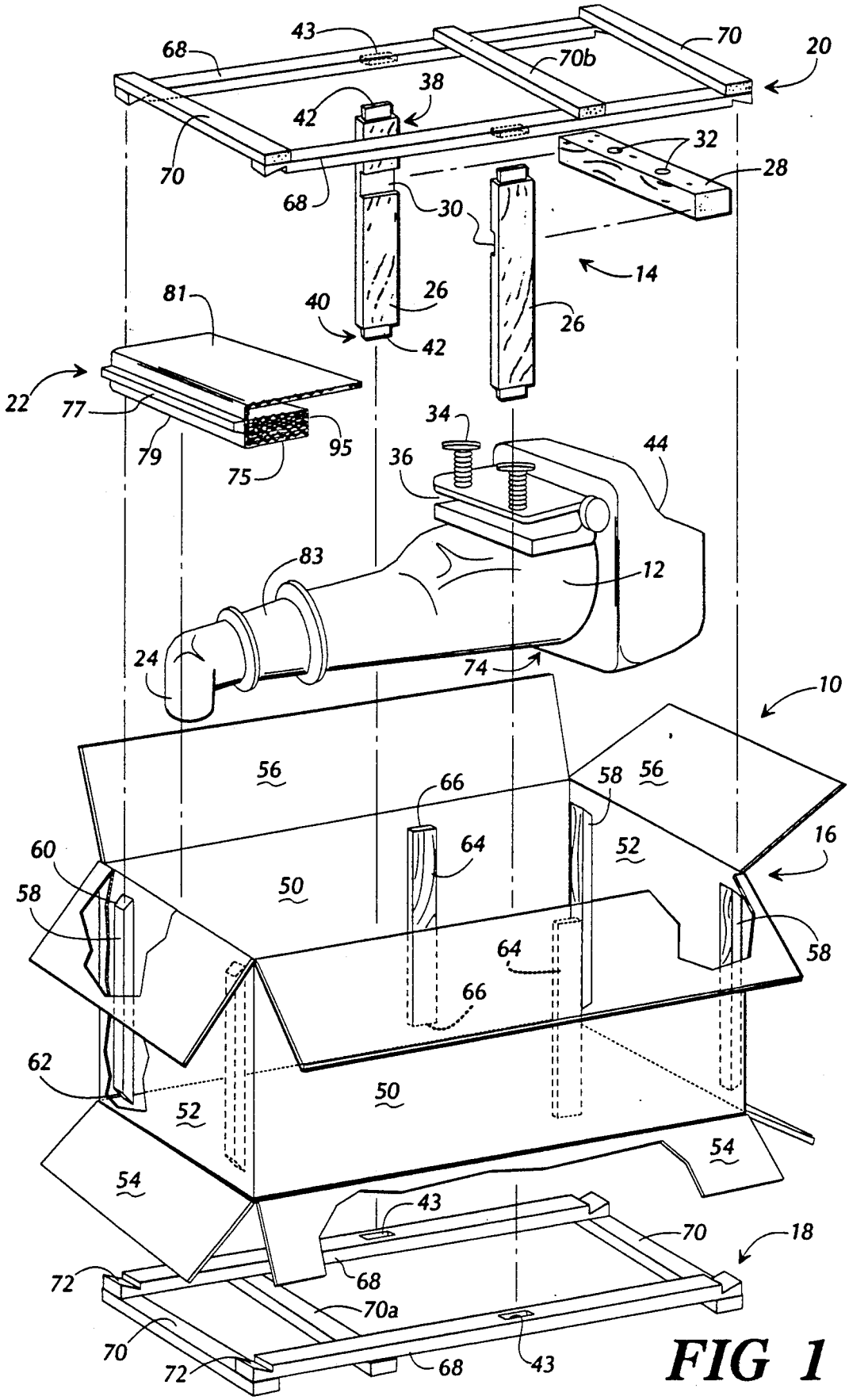
FIG. 1 is an exploded perspective view of a shipping container for holding an outboard motor horizontally.

Referring now in more detail to the drawings, in which like numerals indicate like parts throughout the several views, FIG. 1 illustrates an exploded perspective view of a preferred embodiment of a container 10 according to the present invention for holding an outboard motor 12 horizontally for storing and shipping. The motor 12 attaches to an H-frame 14 for being received in the container 10. The H-frame 14 inserts into a cleated box 16 made of corrugated paperboard which receives a bottom and a top frame 18 and 20, respectively. A hold-down pad 22 attaches to a side wall of the container 16 for receiving a skeg 24 of the motor 12 to restrict the motor from pivoting about the H-frame 14.

The H-frame 14 comprises two vertical side rails 26 and a cross bar 28. The side rails 26 include a notch 30 in an upper portion. The cross bar 28 sits in the respective notches 30 so that vertical forces, for example from a top load, are transferred from the cross bar the side rails 26. Also, the fasteners such as nails or screws used to attach the side rails 26 to the cross bar 28 are thereby not subject to shear forces exerted by the weight of the motor. The cross bar 28 preferably includes a plurality of holes 32 in a pattern that corresponds with the screws 34 on a motor stern bracket 36 of the motor 12. The thickness of the cross bar 28 depends on the weight of the motor 12 and the clearance between the attaching screws 34 and a back surface of the stern bracket 36 when the screws are retracted to a maximum opening.

The notches 30 in the side rails 26 accept the longitudinal ends of the cross bar 28. The ends of the cross bar 28 preferably insert into the notches 30 to a depth of about ½ inch. A maximum depth preferably is one-half the thickness of the side rail 26 so that the side rail is not weakened. Screws or nails are typically driven through the side rails 26 into the ends of the cross bar 28 to secure the crossbar to the side rails. Glue may be applied (preferably a hot melt glue or other "gap filling" type of adhesive) to further increase the strength the joint between the side rails 26 and the cross bar 28.

The upper and lower ends 38 and 40, respectively, of the side rails 26 are cut to form a tenon 42 that protrudes to matingly engage a respective mortise 43 in the top and bottom frames 18 and 20, as discussed below, to restrict movement of the H-frame 14 when the container 10 holds a motor 12 for storing and shipping. The thickness of each of the tenons 42 is preferably about one-third the width of the side rail 26 and its length is preferably about ⅛ inch less than the depth of the mortise 43 in the upper and lower frames 18 and 20, as discussed below. The ends of the tenons 42 may be round or beveled to facilitate insertion of the H-frame 14 onto the lower frame 18 in the container 10. The tenons 42 and mortises 43 secure the motor H-frame 14 in an essentially vertical plane while making assembly and disassembly of the container 10 easier. No nailing, gluing or other mechanical fasteners between the H-frame 14 and the frames 18 and 20 are necessary. Such fasteners decrease pack line speed and make removal of the motor, such as by a dealer, more difficult. for example, motors may require rework before being shipped due to a production or quality problem that surfaces after the motors have been packed. Ease of disassembly and prevention of damage to the container parts is desirable, and made possible by, the elimination of nails, glue, screws or other mechanical fasteners between the H-frame 14 and the frames 18 and 20.

The notches 30 in the side rails 26 are preferably at a slight angle to the side rails. The angle depends on the angle of the stern bracket 36 of the particular brand of outboard motor 12 to be packed. Typically, the stern bracket is not parallel to the motor centerline (vertical), but is at an angle to allow proper mounting of the motor to a stern of a boat. The angle of the notches 30 also depends on the shape of the motor powerhead 44 and the clearance between the lowermost part of the powerhead and the lower frame 18 of the container 10.

The cleated box 16 is preferably formed from a blank of corrugated paperboard folded on scores to define two opposing side walls 50 and two opposing end walls 52. The cleated box 16 in the illustrated embodiment also includes bottom flaps 54 and top flaps 56. The flaps 54 and 56 foldably join to the side walls 50 and end walls 52 on scores. The flaps fold on the scores to close the container 10. The corrugated paperboard box 16 is known in the industry as a regular slotted carton. A flap (not illustrated) known in the industry as a manufacturer's joint foldably attaches on a score to an edge of the blank. The manufacturers joint connects the longitudinal ends of the blank together when the blank is folded to form the tube-like box 16.

A pair of corner cleats 58 attach to each of the end panels 52. The corner cleats 58 are preferably made of wood, solid fibre, or some other dense material that provides adequate stacking strength to meet the stacking and safety factor requirements for container 10 to hold an outboard motor 12. The cross-sectional area of the cleats 58 depends on the particular material used, the stacking requirements, and safety factors. Container manufacturers typically use a safety factors of 3 to 1 for wooden corner posts, and 4 to 1 for paperboard parts which are less resilient and more subject to strength loss in high humidity conditions. The ratio of the safety factor refers to a requirement that the lowest container in a stack be capable of withstanding a force of 3 times the expected load placed upon it in a stack of a given number of loaded containers 10. For example, a seven-high stack of 500 lb. motors would exert a force of 3000 lbs on the bottom box. With a 3 to 1 safety factor, the container in this example should be designed to withstand a 9000 pound top load before failure.

The longitudinal ends 60 and 62 of each cleat 58 preferably are beveled for mating engagement with the frames 18 and 20, as discussed below. In a preferred embodiment this angle is 24 degrees, but may range as low as about 10 degrees.

A side cleat 64 attaches to each of the side panels 50 intermediate the end panels 52. The lower and uppers ends 66 of each side cleat 64 are squared-off for contacting the bottom and top frames 18 and 20, respectively. The side cleats 64 guide the motor 12 and motor frame 14 assembly as it is lowered into the container 10. This facilitates the mating of the tenon 42 on side rails 26 with the mortise 43 in the frames 18 and 20, as discussed below.

The corner cleats 58 and the side cleats 64 are rigidly attached to the end and side panels 50 and 52 respectively by glue, staples, or a combination, as is known to those skilled in the art. In a preferred embodiment, the glue is polyvinyl alcohol (PVA) and the staples have a 1 inch crown and 1 inch leg. The staples are placed about 4 inches apart at a 45 degree angle to provide maximum contact of corrugated paperboard to wood cleat.

The lower frame 18 and the upper frame 20 each include a pair of spaced-apart parallel longitudinal runners 68 and at least three transverse members 70. The runners 68 and the members 70 are nailed, stapled, glued or otherwise fastened together. The longitudinal ends 72 of the runners 68 are preferably tenoned with a half-dovetail to form a socket, or bevel-notch, to receive and mate with the respective longitudinal end 60 or 62 of the corner cleats 58 on the end walls 52. The width of the notches is typically ⅛ inch greater than the thickness of the corner cleats 58, with a depth of about ½ inch and a slope of about 24 degrees. The bevel-notch locks the corner cleats 58 when the container 10 receives a stacking load. The joint between each corner cleat 58 and end 72 becomes tighter under load. This prevents the corner cleats 58 from slipping off the frames 18 and 20 which may result in collapse of the stack of containers and possible injury to persons or damage to the motor held in the container 10. The lower frame 18 also provides a bearing surface for the blades of a forklift truck. The frames 18 and 20 also provide horizontal stiffness to resist clamp truck platen force exerted on container sidewalls. The frames 18 and 20 distribute the load from stacked containers and accommodate misaligned stacking or shifting during stacked shipment where one container 10 may not be properly aligned with the others in the stack.

The intermediate transverse member 70*a* of the lower frame 18 is positioned under the edge of the cavitation plate (not illustrated) near the propeller end 24 of the motor 12. This is a contact point at which the propeller end of the motor is held down against the lower frame 18. A polyfoam pad (not illustrated) is preferably attached to the transverse member 70*a* with hot melt glue or other fastener to cushion the cavitation plate from shock if a drop occurs and to prevent paint abrasion. A preferred foam block is polypropylene material with a thickness of about ½ inch and 4 pounds per cubic foot density.

The longitudinal runners 68 each include the mortise 43 intermediate the ends 72. The mortises 43 are disposed for mating with the tenons 42 on the side rails 26. The mortises 43 position the motor 12 longitudinally in the container 10 with clearances between the powerhead 44 and the respective end panel 52 and between the skeg 24 and the other end panel. For example, outboard motors with different drive shaft lengths, gearcase lengths, or powerheads 44, require the position of the mortises 43 to be moved to achieve the desired clearances between the outboard motor 14 and the end panels 52. The size of the mortise 43 preferably is slightly larger in width and length than the tenon 42 on the side rails 26. This facilitates easier assembly of the container 10 on a motor manufacturing pack line. The mortise 43 preferably has a width about ¼ inch greater than the thickness of the tenon 42 and a length about ½ to ¾ inch longer, depending on the end profile of the mortise 43 (rounded or square cut). The depth of the mortise 43 is preferably about ⅛ inch greater than the height of the tenon 42 on the side rail 26.

As discussed above, the upper frame 20 is similar in construction to the lower frame 18 and in some instances is identical. However, the position of the transverse member **70*b* in the top frame 20 may be different than the member 70*a* in the bottom frame 18 due to the shape and configuration of the motor 12 or due to having to protect vulnerable portions of the motor cover with the transverse member. Typically the length and width of the top frame 20 are the same as the lower frame 18, and only the location of the center transverse members 70*a* and 70*b* are varied as discussed to protect parts of the motor 12 vulnerable to damage in cases of top loading dissimilar size packages. Normally no foam block is required on the transverse member 70*b*** as the upper frame does not contact the motor at any place.

Figure 3:
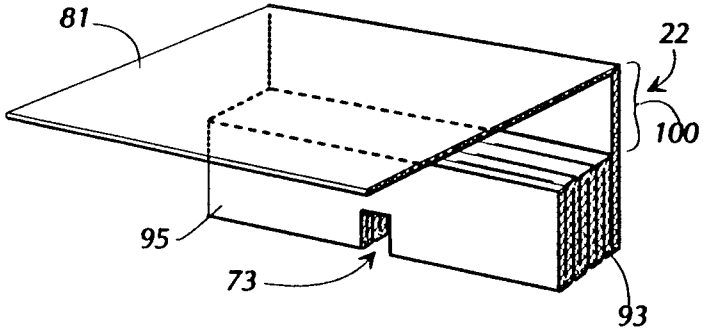
FIG. 3 is a front view of the hold-down pad for the container illustrated in FIG. 1.

The hold-down pad 22 comprises a plurality of corrugated sheets 75 layered and adhered together for strength and rigidity. The hold-down pad 22 attaches to the end wall 52 on the propellor end of the motor 12. The pad 22 includes a tapering cutout 73 that conforms in shape to the skeg 24 for matingly engaging the skeg. FIG. 3 illustrates a front view of the hold-down pad showing the cutout 73. The cutout 73 is a narrow slot for receiving the skeg of the motor.

The hold-down pad 22 grips the skeg 24 in the cutout and restrains the skeg from pivoting upward due to the unbalanced weight distribution of the motor 14. Typically, the powerhead 44 of the motor 12 is the heaviest part. The motor 12 attaches at its stern bracket 36 to the cross bar 28 of the H-frame 14. The stern bracket 36 typically is located below the powerhead 44 toward the skeg 24, as illustrated. The weight of the powerhead 44 tends to cause the cross bar 28 to twist and flex, and would result in excessive movement of the motor 12 in the vertical plane if the skeg 24 were not held firmly so that the cavitation plate of the motor 12 rests against the foam pad as described above. The hold-down pad 22 further grips the skeg 24 to prevent the motor 12 from pivoting side-to-side about the steering pivot on the stern bracket 36. If such pivoting were not restricted, the motor 12 would be free to swing transversely on the steering pivot, and thus reducing clearances in the cleated box 16 and subjecting the cover of the motor to possible damage. The hold-down pad 22 restricts transverse movement of the skeg and powerhead during handling. These forces might result in motor cover contact of the motor with or through the walls of the container 10 with resultant damage. This could occur, even though the stern bracket 36 is screw-clamped to the cross bar 28, because of the imbalance of the weight distribution in the motor 12. For example, the momentum of the powerhead 44 in a drop from a trailer height (typically 48 inches) could cause the powerhead to twist about the cross bar 28 if the hold-down pad 22 were not attached to the end panel 52.

In the illustrated embodiment, an end block 77 of a length essentially equal to the spacing between the corner cleats 58 attaches to a rear surface 79 of the pad 22. The block 77 restrains the hold-down pad 22 from transverse movement during a drop or other shock force experienced during handling. This prevents the skeg 24 of the motor 12 from moving in the box 16. The corner cleats 58 are securely fixed to the end panel 52. The cleats 58 form a rigid set of stops for the end block 77 to resist side impacts. Without the block 77, a side impact imparting momentum to the powerhead 44 could cause the skeg 24 to whip sideways through the relatively flexible corrugated side panels 50 of the box. The powerhead 44 may thereby move sufficiently to contact hard surfaces outside the container and possibly damage the motor, its cover, or the powerhead.

In the preferred embodiment, a panel of corrugated paperboard forms a shelf 81 that extends over the gearcase 83 of the motor 12. The shelf 81 holds spare parts and accessories shipped within the container 10. Typically a gas tank is shipped with the motor in the container, and the gas tank is usually enclosed in its own lightweight corrugated shipping box (not illustrated). The shelf 81 comprises an L-shaped panel of corrugated paperboard attached with an adhesive to the pad 22. The panel forms the rear surface 79 of pad 22 to which wood block 77 is attached. The shelf 81 extends outwardly substantially horizontal over the motor gearcase 83. A foam block (not illustrated) is preferably attached to the undersurface of the shelf 81 to rest on the rear edge of the motor cavitation plate. The foam block prevents the cavitation plate from punching into or damaging the gas tank or accessories on the shelf 81. The foam block also prevents paint abrasion of the motor cavitation plate, much as the foam block on the intermediate member **70*a* in the lower frame 18** does.

Figure 2:
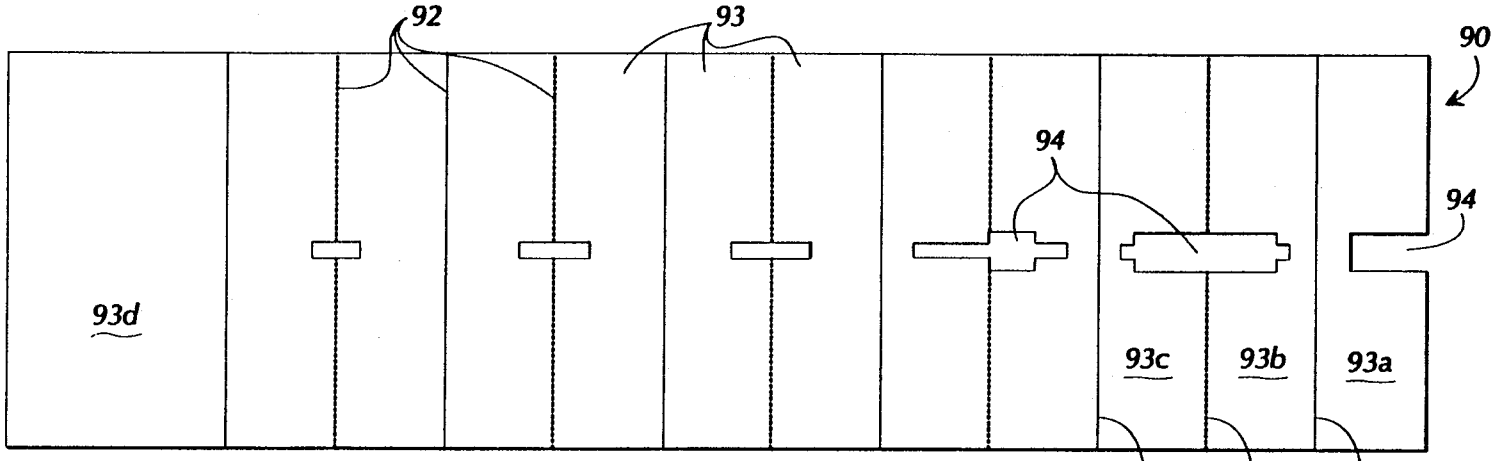
FIG. 2 is a plan view of a sheet of corrugated paperboard scored for folding to form the hold-down pad for the container illustrated in FIG. 1.

FIG. 2 illustrates a blank 90 of corrugated paperboard having a plurality of spaced-apart perforated scores 92 alternating on the top and bottom surfaces of the blank. The perforations help the blank to fan-fold to form the hold-down pad 22. The scores 92 define a plurality of panels 93. The panels 93 in the blank 90 fan-fold facing surfaces on the scores 92 to form the hold-down pad 22. For example, the bottom surfaces of the panels **93*a* and 93*b* meet by folding the panel 93*a* on the score 92*a*. The top surfaces of the panels 93*b* and 93*c* meet by folding on the score 92*b*. A series of slots 94 is die-cut into the paperboard blank 90. The slots 94 extend from the score 92 on the bottom surface towards the scores on the upper surface of the panels 93. When the blank 90 is fan-folded, the slots 94 overlay one another, resulting in the tapering cutout 72 which approximates the contour of the skeg 24**.

The slots 94 open on the inside face 95 of the hold-down pad 22. The edges of the panels 93 exposed by the slots 92 in the upper surface form the rear face 79 of the hold-down pad 22. An adhesive, such as P.V.A. or hot melt glue, is preferably applied to the blank 90 on alternate sides and panels 93 so that when the blank is folded and compressed in a laminator, the layers of paperboard bond together to form the rigid, yet shock-absorbing pad 22. The last panel **93*d* in the blank 90 preferably is wider than the other panels 93 in order to form the shelf 81 discussed above. The thickness of the pad 22, the size of the slots 94 and the resultant skeg cutout when the blank 90 is folded and laminated, and the width and length of the pad are dependant on the size of the skeg, the width of the container 10, and the clearance between the skeg and the end panel 52. The direction of corrugation of the blank 90 preferably is transverse with respect to the box 16 rather than vertical. The pad 22 thereby best resists the sharp edge of the skeg 24** from cutting through the pad during handling, such as in a drop.

Figure 4:
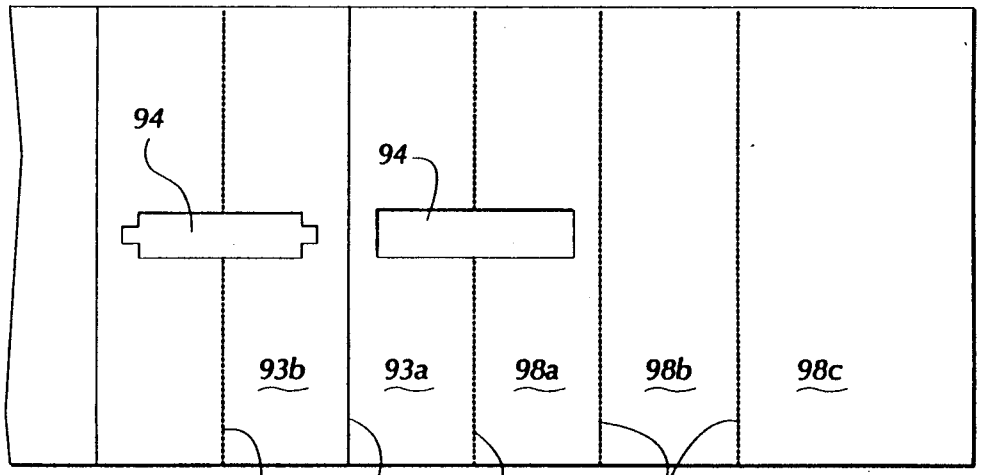
FIG. 4 is a cut-away plan view of an alternate embodiment of the sheet illustrated in FIG. 3.

FIG. 4 illustrates a preferred embodiment of the blank 90 for the hold-down pad 22. In this embodiment, the blank 90 includes a cover portion generally designated 96 that foldably attaches on a perforated score 97 in the lower surface of the blank. The cover portion 96 includes a bottom panel 98*a*, a side panel 98*b*, and a shelf panel 98*c*. The side and shelf panels 98*b* and 98*c* foldably join along spaced-apart scores 99 in the lower surface of the blank 90. When the blank 90 is folded into the hold-down pad 22, the side panel 98*b* folds against the back edges of the panels 93 to define the back face 79 of the hold-down pad. The shelf panel 98*c* folds and extends across the top of the hold-down pad 22 to contact a portion of the gearcase of the motor 12. As illustrated in FIG. 3, there is preferably a gap 100 between the top of the pad 22 and the shelf, so that the shelf sits horizontally in contact with the gearcase housing. In this embodiment, the panel 93*d* (illustrated in FIG. 2) is the same width as the other panels 93.

The hold-down pad 22 engages the skeg 24 of the outboard motor 12 that attaches to the cross-bar 28 in the H-frame 14. The blank of corrugated paperboard 90 fan-folds on the spaced-apart scores 92 that are impressed alternately in the upper surface and the lower surface of the blank. The scores 92 define the panels 93 in the blank. The slots 94 define a series of openings in the blank 90 and each generally extends along the longitudinal axis of the blank from each score towards an adjacent panel. The slots form the channel-like cutout 73 for receiving the skeg 24 of the motor 12. The sides and width of the slots 92 therefore conform to the shape of the skeg which varies depending on the size of the motor and the manufacturer. Generally, the length of the slots 92 decrease from a first longitudinal end of the blank 90 to a second longitudinal end. At least one panel 93*d* adjacent the second end does not include one of the slots 92. Folding the blank 90 on the scores 92 forms the pad 22 of corrugated paperboard and the slot 94 define the cutout 73 for receiving the skeg 24. The last panel 93*d* preferably has a width greater than that of the other panels 93 for the shelf 81 that extends horizontally over the gearcase housing 83 of the outboard motor 12.

With reference to FIG. 1, the container 10 squares open into a rectangular tube and the bottom frame 18 inserts into an open end. The beveled ends 62 of the corner cleats 58 engage the bevel notch at the ends 72 of the runners 68. The flaps 54 fold over to close the bottom of the container 10. Staples, tape, or the like secure the flaps 54. The motor 12 attaches to the cross bar 28 by screwing the bolts 34 on the stern bracket 36 into the holes 32. A hoist lifts the motor 12 and the frame 14 over the open container 10. The side rails 26 slidingly contact the cleats 64 which guide the frame 14 into the container 10. The lower tenon 42 enters the mortise 43 in the runner 68. The hold-down pad 22 inserts over the skeg 24 with the end block 77 received between the corner cleats 58. Staples secure the hold-down pad 22 in position. The top frame 20 inserts in the container and engages the upper ends 60 of the cleats 58. The tenon 42 on the frame 14 inserts into the mortise 43. The flaps 56 fold on scores to close the container 10.

The cleated box 16 tightly encloses and envelopes the lower frame 18, the upper frame 20, the motor frame 14, and the hold-down pad 22. The box 16 cooperates with the corner cleats 58 to provide stacking strength. The box 16 and walls 50 and 52 provide rack resistance, or torsional stability, to maintain the corner cleats 58 in a substantially vertical plane even when containers are stacked in a warehouse or in shipment. The stopping and starting motion of the trucks or rail cars causes the upper units in a stack to exert high lateral forces against the lower units. The strength of the corrugated paperboard must be adequate to prevent tearout, primarily at the corners, during such stacked shipment. If tearout does occurs, sideways collapse of the containers may result in injury to persons and damage to the motors. It has been found that a double wall board of 350 mullen test or greater is of sufficient strength for motors of up to 70 horsepower, whereas 400 test to 600 test is required for motors up to 300 horsepower. However, new developments in board strength, including poly tear tape and high performance liners could result in lesser board weights being of sufficient tear or tensile strength and such changes do not depart from the spirit of the invention.

When the container 10 is assembled, the upper and lower frames 18 and 20 mate with the corner cleats 58 so that the bevels on the ends 60 and 62 force into the bevel-notches on ends 72 of the frames to form a positive joint. This joint restricts dislodging of the cleats 58 from the frames 18 and 20 under the forces exerted by clamp trucks, and by the lateral, or torque related, forces incurred during warehouse stacking and shipment. The spacing between the upper and lower ends of the cleats 58 to the scores for the flaps 54 and 56 depends on the combined thickness of the wood members making up the frames 18 and 20, less the depth of the bevel-notch 72, plus a standard scoring allowance to allow the flaps to fold over easily yet tightly against the frames during final closure. The cleats 58 are spaced a distance from the corners by an allowance amount to allow the box to be "squared up" properly, yet as close as possible to the corners.

The cleats 64 are positioned on the side panels 50 so that when the lower frame 18 inserts into the bottom end of the cleated box 16 and lock onto the corner cleats 58, the mortise 43 on the side rails 68 align with the edge of the cleats. Thus when the motor frame 14 with motor 12 mounted to it is lowered into the box 16 (typically by electric hoist), the cleats 64 guide the side rails 26 into the box so that the tenons 42 on the lower end of the side rails matingly engage the mortises 43. Without the cleats 64, the motor 12 and motor frame 14 assembly would tend to sway as it lowers into the container 10 and proper seating of the tenons 42 in the respective mortises 43 would be difficult at assembly line speeds. The side cleats 64 also prevent the motor frame 14 with the motor 12 from falling forward towards the heavy powerhead 44 end of the container 10. The upper frame 20 mates with the upper tenons 42 on the side rails 26 and prevents both forward and backward movement of the motor frame 14 in the container 10.

The principles, preferred embodiments and modes of operation of the present invention have been described in the foregoing specification. The invention is not to be construed as limited to the particular forms disclosed because these are regarded as illustrative rather than restrictive. Moreover, variations and changes may be made by those skilled in the art without departing from the spirit of the invention as described by the following claims.

What is claimed is:

1. A container for an outboard motor, comprising:

a bottom and a top frame, each comprising a pair of side members and joined together at the respective ends by two spaced-apart cross members;

a regular slotted carton of corrugated paperboard having two opposing side walls and two opposing end walls sized for receiving the bottom and top frames, a pair of first cleats attached vertically to each of the end walls, and a second cleat attached vertically to each side wall intermediate the end walls, the lower and upper ends of the first and the second cleats contacting the respective side members of the bottom and top frame;

an H-frame motor mount including a pair of vertical side rails joined together by a cross bar for receiving a stern bracket of an outboard motor;

a hold-down pad formed of layers of corrugated paperboard adhered together and having a channel therein along a transverse axis for receiving a skeg of the outboard motor;

a transverse bar attached to a side face of the hold-down pad for being received between the cleats on one end of the end walls, whereby the side rails of the H-frame, being inserted into the carton with a motor attached to the cross bar, contact the second cleats to hold the motor therein and the hold-down pad, being attached to the end wall between the pair of cleats, matingly receives the skeg to resist the motor from pivoting about the cross bar.

2. The container as recited in claim 1, wherein the hold-down pad comprises a plurality of sheets of corrugated paperboard adhered together with an adhesive and the channel tapers from a lower surface to the upper surface for matingly engaging the skeg.

3. The container as recited in claim 1, wherein the hold-down pad comprises a blank of corrugated paperboard having a plurality of spaced-apart scores alternately in an upper surface and a lower surface for folding the blank on the scores to form the blank.

* * * * *